US005337127A

United States Patent [19]

Imaue

[11] Patent Number: 5,337,127

[45] Date of Patent: Aug. 9, 1994

[54] IMAGE FORMING APPARATUS HAVING BIASED TRANSFER ROLLER

[75] Inventor: Yukihisa Imaue, Ikoma, Japan

[73] Assignee: Sharp Kabushiki Kaisha, Osaka, Japan

[21] Appl. No.: 997,694

[22] Filed: Dec. 23, 1992

[30] Foreign Application Priority Data

Jan. 7, 1992 [JP] Japan ..... 4-000616

[51] Int. Cl.[5] ..... G03G 15/16

[52] U.S. Cl. ..... 355/271; 355/274

[58] Field of Search ..... 355/271, 273, 274, 296, 355/264, 305

[56] References Cited

U.S. PATENT DOCUMENTS 4,183,655 1/1980 Umahashi et al. ..... 355/274
4,349,270 9/1982 Wada et al. ..... 355/305
5,253,022 10/1993 Takeuchi et al. ..... 355/274

FOREIGN PATENT DOCUMENTS 51-9840 1/1976 Japan .
56-123577 9/1981 Japan .
61-226773 10/1986 Japan .
63-286878 11/1988 Japan .
1-316775 12/1989 Japan ..... 355/274
3-69978 3/1991 Japan .

*Primary Examiner*—Joan H. Pendegrass
*Attorney, Agent, or Firm*—David G. Conlin; George W. Neuner

[57] ABSTRACT

An image forming apparatus has a charger for charging a photosensitive body; a developing device for developing an electrostatic latent image formed on the photosensitive body to form a toner image; and a transfer device for transferring the toner image to a transferred material by a transfer roller to which a bias having a polarity reverse to that of toner is applied. At a pre-rotating time of the transfer roller, a bias having the same polarity as toner is applied to the transfer roller for a time equal to or greater than a time required to rotate the transfer roller at one time such that it is possible to prevent normal toner from being attached to the transfer roller. After a constant time has passed, a voltage of the transfer roller is set to zero volt so that reversed toner attached to the transfer roller is moved to the photosensitive body to which the bias having polarity reverse to that of toner is applied.

3 Claims, 3 Drawing Sheets

IMAGE FORMING APPARATUS HAVING BIASED TRANSFER ROLLER

BACKGROUND OF THE INVENTION

1. Field of the Invention

The present invention relates to a image forming apparatus in an electrostatic transfer system. More particularly, the present invention relates to cleaning of a transfer device for transferring a toner image of a photosensitive body to a transferred material.

2. Description of the Related Art

In a transfer device in a general image forming apparatus, a bias having polarity reverse to that of toner is applied to a transfer roller so that a toner image on a photosensitive body is transferred to a transferred material such as paper.

In this case, a rear side of the transferred material becomes dirty if no attachment of toner onto the transfer roller is prevented at a pre-rotating time of the transfer roller in an initial transfer operation and an interval of sheets of paper at a continuous paper feeding time.

Therefore, Japanese Patent Application Laying Open (KOKAI) No. 3-69978 shows a technical structure for preventing the attachment of toner onto a transfer member. In this structure, a bias is applied to the transfer member when there is no transferred material. This bias has a predetermined polarity and is applied to the transfer member for a time equal to or greater than a time required to rotate the transfer member at one time. Thereafter, the polarity of the bias is reversed and this bias is applied to the transfer member for a time equal to or greater than a time required to further rotate the transfer member at one time, thereby preventing toner from being attached to the transfer member.

However, when the above bias is switched to a bias at a transfer time at fast timing corresponding to one rotation of the transfer member, normal toner is developed since a voltage such as several ten volts is applied to the photosensitive body and this photosensitive body has polarity reverse to that of the normal toner. Therefore, a rear side of the transfer member becomes dirty at the transfer time.

There is also a problem that a power source is burdened when polarities of the bias are rapidly changed from a cleaning time to the transfer time, and from the transfer time to the cleaning time.

SUMMARY OF THE INVENTION

It is therefore an object of the present invention to provide an image forming apparatus for preventing the rear side of a transferred material from becoming dirty by controlling a bias applied to a transfer member without burdening a power source.

The above object of the present invention can be achieved by an image forming apparatus comprising a charger for charging a photosensitive body; a developing device for developing an electrostatic latent image formed on the photosensitive body to form a toner image; and a transfer device for transferring the toner image to a transferred material by a transfer member to which a bias having polarity reverse to that of toner is applied. In the image forming apparatus, the bias applied to the transfer member has the same polarity as toner for a time equal to or greater than a time required to rotate the transfer member at one time when there is no transferred material. The application of the bias is stopped for a time equal to or greater than a time required to rotate the transfer member at one time before the bias having polarity reverse to that of toner at a transfer time is applied to the transfer member.

In an image forming process of the above image forming apparatus, the transfer member is first rotated in advance. When a problem such as a paper jam is caused, a bias having the same polarity as toner is applied to the transfer member such that no toner attached to the photosensitive body comes in contact with the transfer member. This bias is applied to the transfer member for a time equal to or greater than a time required to rotate the transfer member at one time.

After a constant time has passed, a voltage of the bias applied to the transfer member is set to zero volt. Thus, reversed toner attached to the transfer member is moved to the photosensitive body so that the transfer member is cleaned. At this time, since the photosensitive body has the same polarity as this toner, no normal toner is moved to the photosensitive body.

Accordingly, it is possible to prevent a rear side of the transferred material from becoming dirty by controlling the bias applied to the transfer member without burdening a power source.

Further objects and advantages of the present invention will be apparent from the following description of the preferred embodiments of the present invention as illustrated in the accompanying drawings.

DESCRIPTION OF THE PREFERRED EMBODIMENTS

The preferred embodiment of an image forming apparatus in the present invention will next be described in detail with reference to the accompanying drawings.

Figure 2:
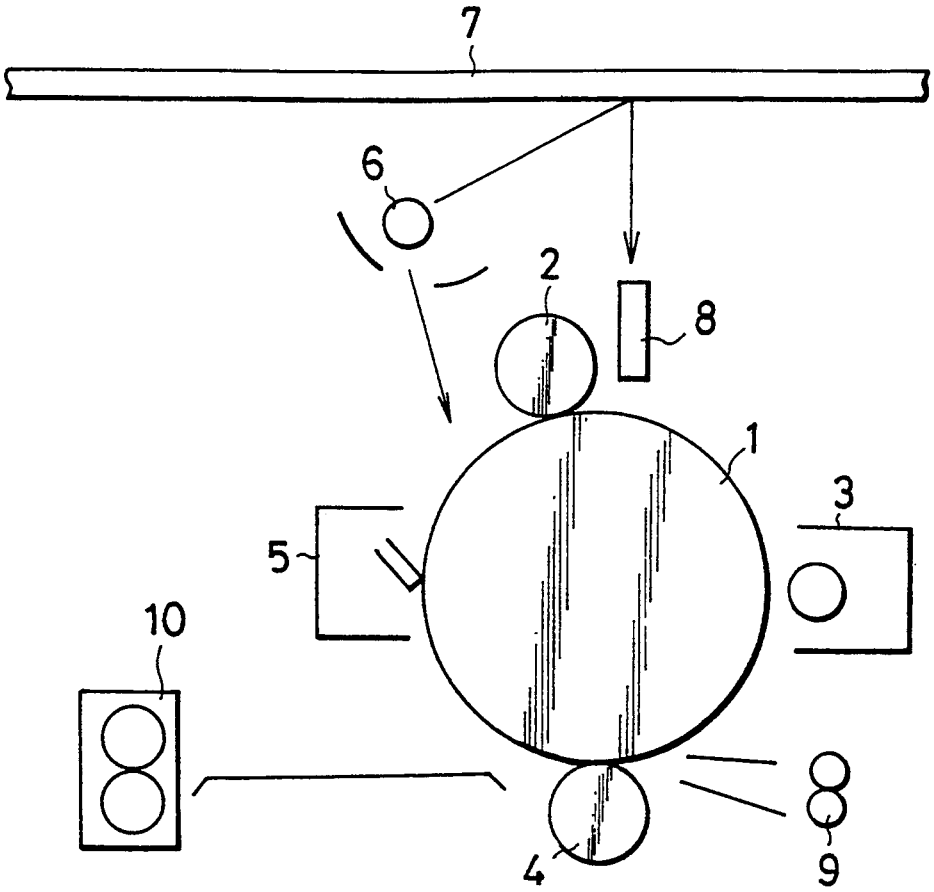
FIG. 2 is a schematic view of a copying machine to which the present invention is applied.

As shown in FIG. 2, a copying machine is the embodiment of the present invention has a charger 2, a developing device 3, a transfer device 4 and a cleaner 5 arranged around an OPC photosensitive body 1.

An exposure section for exposing an image of light reflected on an original is disposed between the charger 2 and the developing device 3. Light from a copying lamp 6 is reflected on the original arranged on an original glass 7 and is irradiated onto the photosensitive body 1 through a SELFOC lens 8.

A discharger using the copying lamp 6 is disposed on this side of the charger 2.

In FIG. 2, reference numerals 9 and 10 respectively designate a roller for conveying a transferred material and a fixing device.

Figure 1:
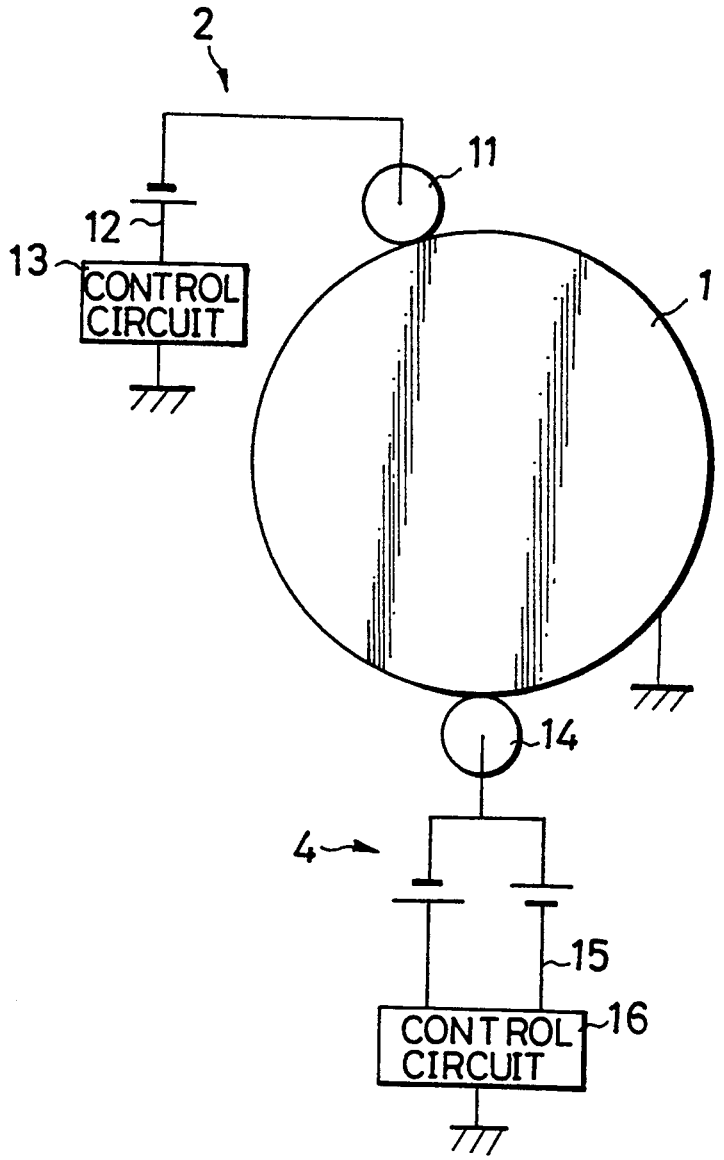
FIG. 1 is a view showing the construction of a main portion of an image forming apparatus in accordance with an embodiment of the present invention.

As shown in FIG. 1, the above charger 2 is constructed by a charging roller 11, a power source 12 for charging, and a control circuit 13 for controlling an operation of the power source 12. When the photosensitive body 1 is rotated, a minus bias is applied to the charging roller 11 such that the photosensitive body 1 is uniformly charged with −700 volts.

The above transfer device 4 is constructed by a transfer roller 14, a power source 15 for applying a plus or minus bias to the transfer roller 14, and a control circuit 16 for controlling and switching plus and minus polarities of the bias.

Figure 3:
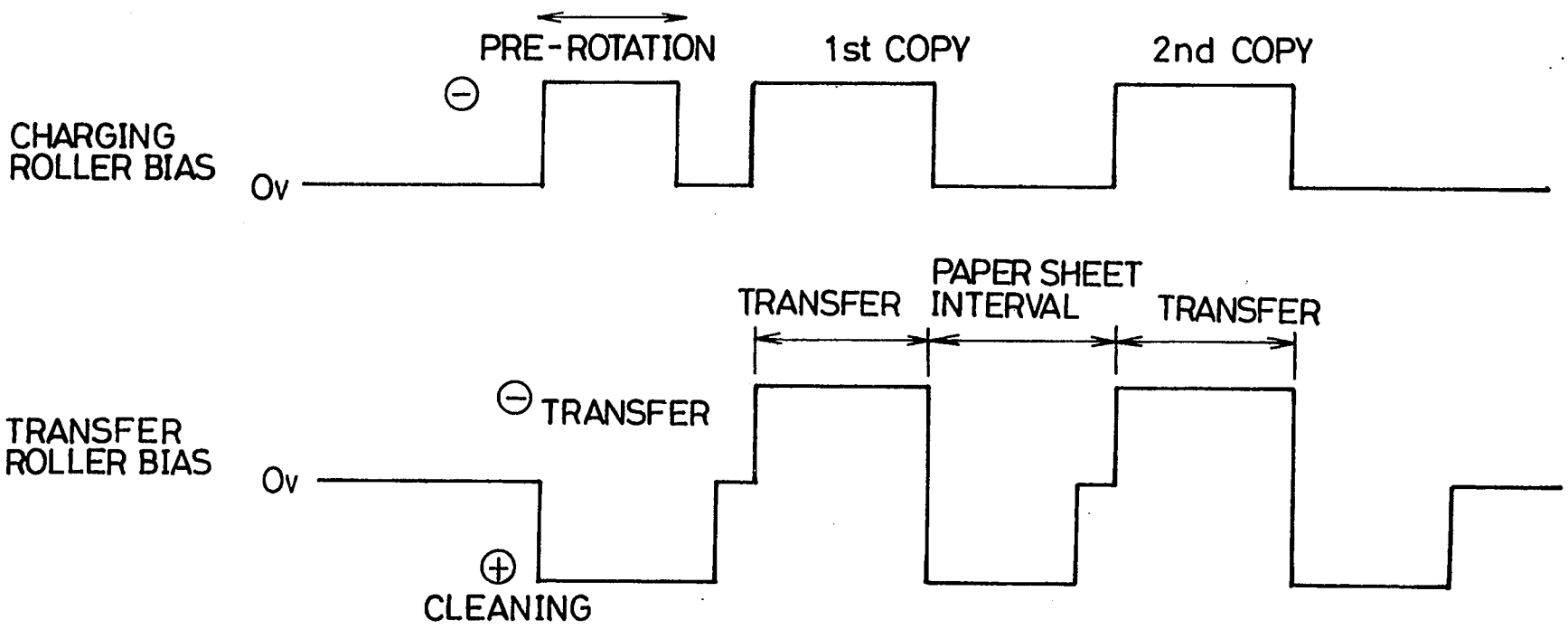
FIG. 3 is a timing chart of a bias applied to a transfer roller.

As shown in FIG. 3, the control circuit 16 sets polarity of the bias applied to the above transfer roller 14 to the same polarity as toner for a time equal to or greater than a time required to rotate the transfer roller 14 at one time such that the transfer roller 14 is cleaned when there is no transferred material. The control circuit 16 also sets an applied voltage of the bias to zero volt for a time equal to or greater than a time required to rotate the transfer roller 14 at one time until the bias having polarity reverse to that of toner at a transfer time is applied to the transfer roller 14. At the transfer time, the bias having polarity reverse to that of toner is applied to the transfer roller 14 by the control circuit 16.

In the copying machine constructed above, a surface of the photosensitive body 1 is charged by the charger 2 with −700 volts. Light as an image reflected on the original from the copying lamp 6 is irradiated to the photosensitive body 1 through the SELFOC lens 8, thereby forming an electrostatic latent image. When the latent image reaches the developing device 3, toner is supplied from a sleeve of a developing roller and is attached to a latent image portion so that a toner image is formed.

When this toner image next reaches a transfer portion of the transfer roller 14 coming in press contact with the photosensitive body 1, a transferred material is conveyed to the transfer roller 14 in conformity with this timing. A bias having negative polarity is applied to the transfer roller 14 simultaneously when the transferred material comes in press contact with the photosensitive body 1. Thus, the toner image on the photosensitive body is moved onto the transferred material.

Thereafter, the transferred material is fixed by the fixing device 10 and toner left on the photosensitive body is collected by the cleaner 5. Electric charges left on the photosensitive body are discharged by a discharger.

In the above image forming process, the transfer roller 14 is first rotated in advance. When a problem such as a paper jam is caused, a bias having +600 V and the same polarity as toner is applied to the transfer roller 14 such that no toner attached to the photosensitive body 1 comes in contact with the transfer roller 14. This bias is applied to the transfer roller 14 for a time equal to or greater than a time required to rotate the transfer roller 14 at one time.

After a constant time has passed, the voltage of the bias applied to the transfer roller 14 is set to zero volt. At this time, the photosensitive body 1 approximately has a plus potential about several ten volts since a plus voltage has been applied to the photosensitive body 1 till now.

Therefore, reversed toner having a plus voltage and attached to the transfer roller 14 is moved to the photosensitive body 1 by setting the voltage of the transfer roller 14 to zero volt so that the transfer roller 14 is cleaned.

At this time, since the photosensitive body 1 has the same polarity as this toner, no normal toner is moved to the photosensitive body 1.

As mentioned above, the bias having the same polarity as toner is applied to the transfer roller 14 for a time equal to or greater than a time required to rotate the transfer roller 14 at one time with respect to a pre-rotation of the transfer roller 14 and an interval of sheets of paper at a continuous paper feeding time. Thereafter, the voltage of the transfer roller 14 is set to zero volt for a time equal to or greater than a time required to rotate the transfer roller 14 at one time. Thus, it is possible to remove normal charged toner and reversed toner from the transfer roller 14.

Further, the burden of a power source is reduced since polarities of the power source are changed after a voltage of the power source is once set to zero volt.

The present invention is not limited to the above embodiment, but many corrections and modifications can be added to the above embodiment within the scope of the present invention.

For example, a transfer member is constructed by the transfer roller in the above embodiment, but may be constructed by a rotating member such as a belt.

As mentioned above, in accordance with the present invention, a bias having polarity reverse to that of toner is applied to a transfer member for transferring a toner image to a transferred material. The bias applied to the transfer member has the same polarity as toner for a time equal to or greater than a time required to rotate the transfer member at one time when there is no transferred material. The application of the bias is stopped for a time equal to or greater than a time required to rotate the transfer member at one time before the bias having polarity reverse to that of toner at a transfer time is applied to the transfer member. Accordingly, normal charged toner and reversed toner can be removed from the transfer member in a pre-rotation of the transfer member and at an interval of sheets of paper at a continuous paper feeding time.

Further, the burden of a power source for applying this bias is reduced by changing polarities of the power source after a voltage of the power source is once set to zero volt.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming apparatus comprising;

a charger for charging a photosensitive body;

a developing device for developing with a toner an electrostatic latent image formed on the photosensitive body to form a toner image on the photosensitive body; and a transfer device for transferring the toner image to a transferred sheet of paper by a transfer roller, to which a bias having an opposite polarity to that of the toner is applied, the bias applied to said transfer roller being set to the same polarity as that of the toner for a time during which the transfer roller rotates by at least one revolution, during a non-transfer period, then the bias applied to said transfer roller being once set to zero volt for a time during which the transfer roller rotates by at least one revolution, and then, the bias applied to said transfer roller being set to an opposite polarity to that of the toner, during a transfer period.

2. An image forming apparatus according to claim 1, wherein said non-transfer period includes a period during which no sheets are between the photosensitive body and the transfer roller in an interval between sheets of paper at a continuous paper feeding time.

3. An image forming apparatus according to claim 1, wherein said non-transfer period includes a prerotating time of the transfer roller in an initial transfer operation.

* * * * *